US007121214B1

(12) United States Patent
Toltzman et al.

(10) Patent No.: US 7,121,214 B1
(45) Date of Patent: Oct. 17, 2006

(54) LAPTOP DESK FOR PORTABLE COMPUTERS

(75) Inventors: Randall R. Toltzman, Scottsdale, AZ (US); Thomas P. Muday, Scottsdale, AZ (US)

(73) Assignee: Juggernaut Design, LLC AZ limited liability company, Scottsdale, AZ (US)

( * ) Notice: Subject to any disclaimer, the term of this patent is extended or adjusted under 35 U.S.C. 154(b) by 71 days.

(21) Appl. No.: 10/918,132

(22) Filed: Aug. 12, 2004

Related U.S. Application Data

(60) Provisional application No. 60/542,625, filed on Feb. 6, 2004.

(51) Int. Cl.
*A47B 23/00* (2006.01)

(52) U.S. Cl. ..... 108/43; 248/918; 108/50.01

(58) Field of Classification Search ..... 108/43, 108/44; 248/444, 346.05, 446, 454, 455, 248/918

See application file for complete search history.

(56) References Cited

U.S. PATENT DOCUMENTS 3,821,936 A * 7/1974 Morse ..... 108/43
5,623,869 A * 4/1997 Moss et al. ..... 108/43
5,680,973 A * 10/1997 Vulpitta et al. ..... 224/153
5,911,397 A * 6/1999 Jokinen et al. ..... 248/346.01
6,050,200 A * 4/2000 Sullins et al. ..... 108/43
6,101,086 A * 8/2000 Kim et al. ..... 361/683
6,170,405 B1 * 1/2001 Weitzman et al. ..... 108/25
6,193,118 B1 * 2/2001 Kearl ..... 224/153
6,234,085 B1 * 5/2001 Ramundo ..... 108/43
6,269,948 B1 * 8/2001 Jackson ..... 206/320
6,305,652 B1 10/2001 Borke et al.
6,353,530 B1 * 3/2002 Zarek et al. ..... 361/683
6,496,360 B1 12/2002 Cordes et al.
6,527,243 B1 3/2003 Lord
6,682,038 B1 * 1/2004 Golynsky ..... 248/346.01

* cited by examiner

*Primary Examiner*—Jose V. Chen
(74) *Attorney, Agent, or Firm*—Gregory J. Nelson

(57) ABSTRACT

A portable desk for a laptop computer or similar device. The desk has a rigid panel with a central cutout. Pads are provided on the top surface to receive the computer case to provide friction. Cushions on the underside of the panel engage and stabilize the desk on the user's legs in a sitting position. A mouse pad is hinged to the desk and in a stored position is received in the center cutout and may be deployed to a position adjacent the desk when in use. Heat is dissipated through the central cutout and also along air troughs between the bottom of the case and upper surface of the desk. In one embodiment, the desk may be provided with folding legs which may be deployed to impart an inclination to the working surface. The desk is compact, lightweight and can be conveniently stored in a carrying case alongside the computer when not in use.

12 Claims, 12 Drawing Sheets

LAPTOP DESK FOR PORTABLE COMPUTERS

CROSS-REFERENCE TO RELATED PATENT APPLICATION

This is application is based on U.S. Provisional Patent Application Ser. No. 60/542,625, filed Feb. 6, 2004, of the same title.

FIELD OF THE INVENTION

The present invention relates to a laptop desk for supporting a laptop computer or similar device in a use position supported on the lap of the user when the user is in a sitting position.

BACKGROUND OF THE INVENTION

Over recent years the computer industry has significantly reduced the size of personal computers to provide users with portable devices. As a result, many computer users now rely on notebook or laptop computers which, because of their portability, allow users to work while traveling or when away from the office of home. Advancements in the speed of micro processing chips, battery technology and increased storage capacity have resulted in portable computer devices which are small, light weight and possess the processing capability of earlier desktop PC's.

Because of their portability, these computers are frequently used in locations such as on airplanes, at seminars, in classrooms, between classes and other locations which require the user to operate the notebook or laptop computer by placing the computer in their lap. Typically the portable computer is positioned on the user's lap and the user is required to stabilize the computer in this position while either entering commands by a keyboard or by a mouse. The user is required to balance the computer on his or her knees while performing computing operations which require a great deal of balance and dexterity. While the portable computer provides convenience and accessibility, using a computer in this manner can be awkward, uncomfortable and may also impose excessive strain on the hands and arm muscles of the user due to the position of the computer. It is difficult to maintain a computer in this position and it is not unusual for a computer to slide from a user's lap onto a floor surface causing damage to the computer.

Another problem which occurs with using laptop computers in this way is discomfort and fatigue to the arms and hands. Resting the computer directly on the user's lap can also result in discomfort due to a substantial amount of heat dissipated from the computer. Because users of portable computers are faced with these difficulties, there has developed a need for a laptop table or desk for supporting a laptop computer during use. The prior art contains a number of patents on such devices and a number of products are available which attempt to address this problem but, in most cases, these devices do not satisfactorily solve the various problems discussed above.

The Laptop Desk is commercially available and it is plastic and folds for storage. The product has non-skid rubber on its top and bottom surfaces which will grip the clothes and the computer. When deployed, the Laptop Desk will hold the laptop and will also accommodate a mouse and other devices, such as a cell phone and the size of the computer.

Sharper Image offers a product called the Lap Dog which is a laptop computer carrying case and includes zippered bags which unfold across the user's legs to provide balance and stability.

U.S. Pat. No. 6,527,241 shows an apparatus which is a laptop stand and comprises a concave member having a first portion and a second portion to receive the computer. The first portion is at a height which is substantially higher than the second portion. The invention cantilevers the laptop for cooling. The device is intended to provide cooling and not necessarily intended for use on the lap of the user.

U.S. Pat. No. 5,623,869 shows a lap table for a portable computer having a supple body with a filling material. The filling material may be an inflating gas or Styrofoam beads. The table includes a wall integral with the top surface that receives a footprint of the portable computer and exerts a securing force on the computer.

U.S. Pat. No. 6,305,652 discloses a laptop computer support for supporting a laptop computer on the lap of a user and is adjustable within a defined range of support surfaces angles. The device has three or more hinged panels which can be selectively folded and secured relative to one another in a preferred operational configuration.

U.S. Pat. No. 6,496,360 relates to a laptop portable computer desk which is supported on web strapping that passes over the upper legs of the operator when seated. The strapping is attached to foldable and telescopic sides and center supports of the structure that slide into and fold over the structure forming a package comparable in size to the computer.

The above are representative of the various approaches found in the prior art but nevertheless do not provide satisfactory designs which alleviate the problems outlined above.

BRIEF SUMMARY OF THE INVENTION

Briefly, the present invention is directed to a portable laptop desk for supporting and stabilizing a portable computer in the lap of a seated individual in a comfortable use position. While the invention is described with respect to laptop computers, the device can also be used to support other portable data and electronic devices such as notebook computers, PDAs, electronic data organizers, stylus input devices and the like. The terms "laptop computer" or "portable computer" are broadly used herein to include all such devices.

The laptop desk of the present invention is light weight, portable, compact and can be stored with the laptop computer in a carrying case. One substantial advantage of the device is that it has frictional pads which engage the legs of the user as well as the computer case to provide stability and prevent the device from slipping from the lap of the user. The device also has features which provide and accommodate heat dissipation.

To provide the advantages mentioned, the portable desk of the present invention has a panel or base which is preferably a molded, rigid plastic such as ABS. The panel may be generally rectangular having straight or slightly curved side edges. The panel defines a large central cutout. Generally circular or oval die cut pads of a material having a frictional or tacky surface, such as that material known as thermal plastic elastomer (TPE), are provided at the corners of the panel. The pads serve to provide a surface which will stabilize and retain the computer in position on the desk surface. The pads will also help absorb heat from the computer.

Heat is also dissipated upwardly through the large center hole in the panel which is positioned below the computer when the computer is properly positioned on the top surface of the desk panel. An aperture is provided adjacent one end of the panel to assist the user in removing the desk from storage such as in a computer carrying case.

A flexible hinge is attached to the opposite end. The hinge may be attached to the desk at a living hinge or at a hinge pin. The hinge carries a mouse support which may be a circular ring. Suitable frictional materials such as textured Lexan or neoprene covers the top of the ring to provide a surface on which the user may operate a mouse to navigate and which provide good optical and roller ball read. The hinge allows the mouse ring to be folded in a closed position with the ring received in the center hole of the desk panel. The mouse support may also be a tray which slides in and out of the panel or may be pivotally attached to the panels.

The underside of the panel includes reinforcing ribs which extend peripherally around the panel and peripherally around the center cutout. The reinforcing ribs extend outwardly from the center panel to the peripheral rim for reinforcement. Leg pads extend transversely between the opposite front and rear edges of the panel adjacent to provide cushioning for the device when it rests on the user's legs. The cushioning pads also having a textured surface so as to provide a frictional engagement with the legs of the user to resist the panel sliding from the lap of the user when in use. Typical materials for slide resistance are neoprene, cloth, leather, vinyl or polyurethane and TPE.

In an alternate embodiment of the present invention, two pairs of legs are provided on the bottom. One pair is adjacent the front edge and the other pair adjacent the rear edge. Either pair can be folded to a position projecting from the bottom surface so the desk may be placed in a right- or left-hand position on a surface with one edge elevated to provide an inclined working surface. The legs are foldable to an out-of-the-way, stored position.

BRIEF DESCRIPTION OF THE DRAWINGS

The above sets forth generally the features and advantages of the present invention. Additional features and advantages of the invention will be described set forth in the following detailed description, claims and drawings in which:

DETAILED DESCRIPTION OF THE DRAWINGS

Figure 1:
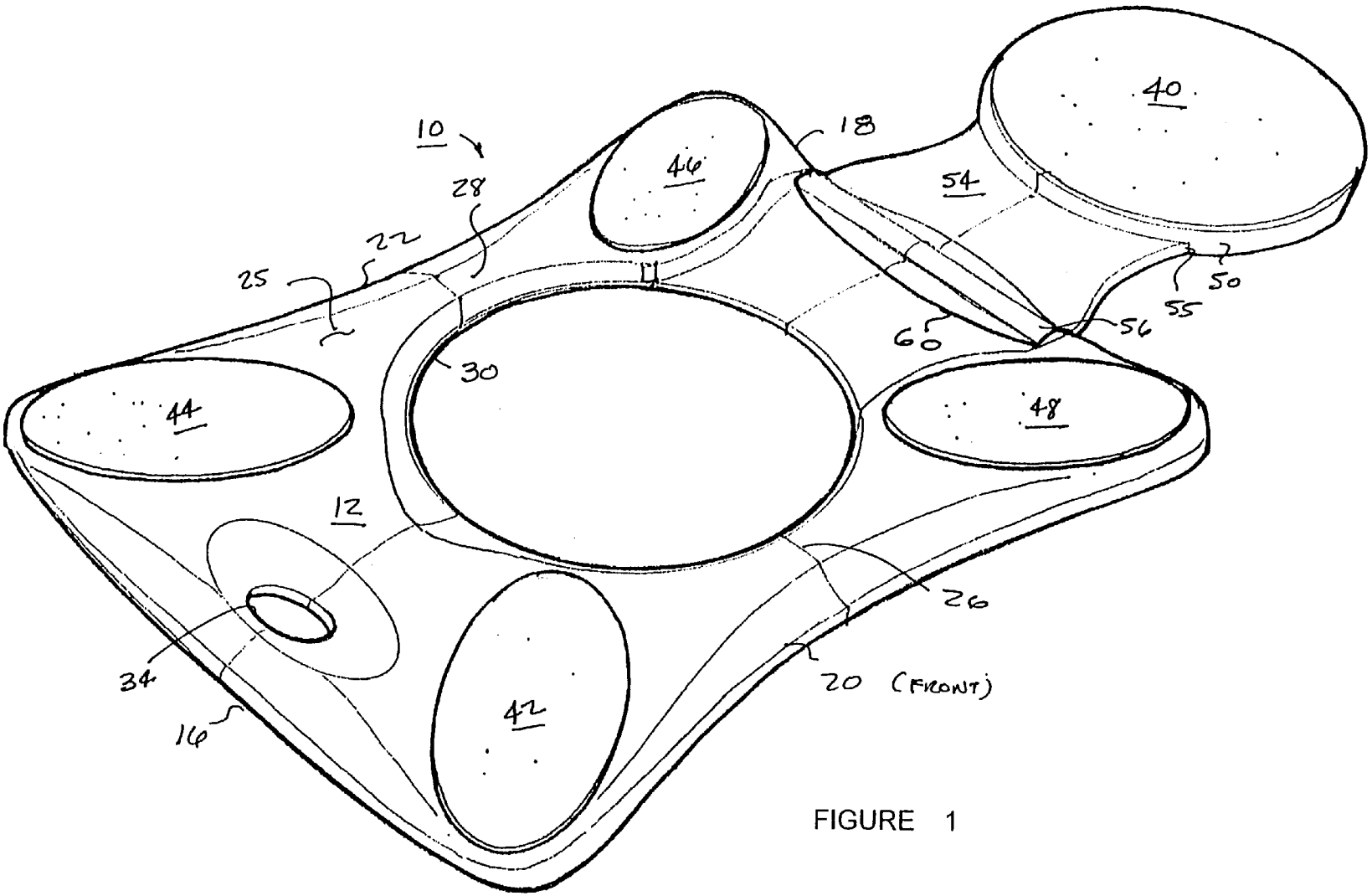
FIG. 1 is a top perspective view of the desk of the present invention shown with the mouse pad in a deployed position.

Turning now to the drawings, the laptop desk of the present invention is generally designated by the numeral 10. The laptop desk has a desk panel 12 which is generally configured to receive and support a portable computer such as a laptop computer LT. The laptop desk has opposite sides 16 and 18 and opposite front and rear edges 20 and 22. The terms "front" and "rear" are used with respect to the orientation shown in FIG. 1 which would be used by right-handed individuals as explained hereafter. Left-handed individuals would normally utilize the desk reversing it from the position shown in FIG. 1.

The laptop desk has a generally rectangular shape and may be configured having a slight curvature along the sides 16, 18 and front and rear edges 20, 22 for aesthetic and functional consideration. The desk panel 12 may be made from a suitable rigid, durable plastic material such as ABS and may be fabricated by conventional techniques such as injection molding.

The laptop desk has an upper surface 25 which is generally planar but may define recesses or troughs 26 and 28 at the side edges which will provide a path for dissipation of heat from the area of the cutout 30. The central cutout 30 is circular and is defined by a peripheral rim 32 depending downwardly from the top surface. The center cutout is provided both to evacuate or dissipate heat from the computer and away from the user and to provide a storage location for the mouse pad 40 as will be described in detail hereafter. A generally oval or circular aperture 34 is provided adjacent side 16. The aperture 34 provides a thumb or finger access location for assisting in removing the desk from a storage position as in a computer carrying case.

Figure 3:
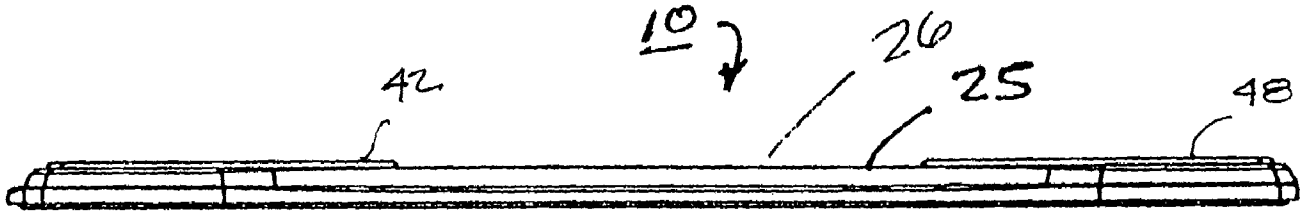
FIG. 3 is a front side view.

One problem with a number of the prior art laptop desks is that they are often made of a hard plastic material which does not provide adequate frictional engagement with the hard plastic material of the computer case. Accordingly, a plurality of pads 42, 44, 46 and 48 are provided at the corners of the desk panel 12. Each of the pads is shown as being generally circular or oval extending from the corner diagonally toward the center hole 30. The pads are a suitable material such as a thermal plastic elastomer (TPE) or neoprene. Neoprene fabric has a texture which will provide the necessary frictional engagement. TPE is a type of material which is an elastomer with a tacky surface which will also serve to stabilize and engage the underside of the computer case to prevent it from slipping from the desk when in use. The pads project or are slightly raised above the planar surface as seen in FIG. 3 thus providing a space for air circulation and heat dissipation from below the computer.

Figure 2:
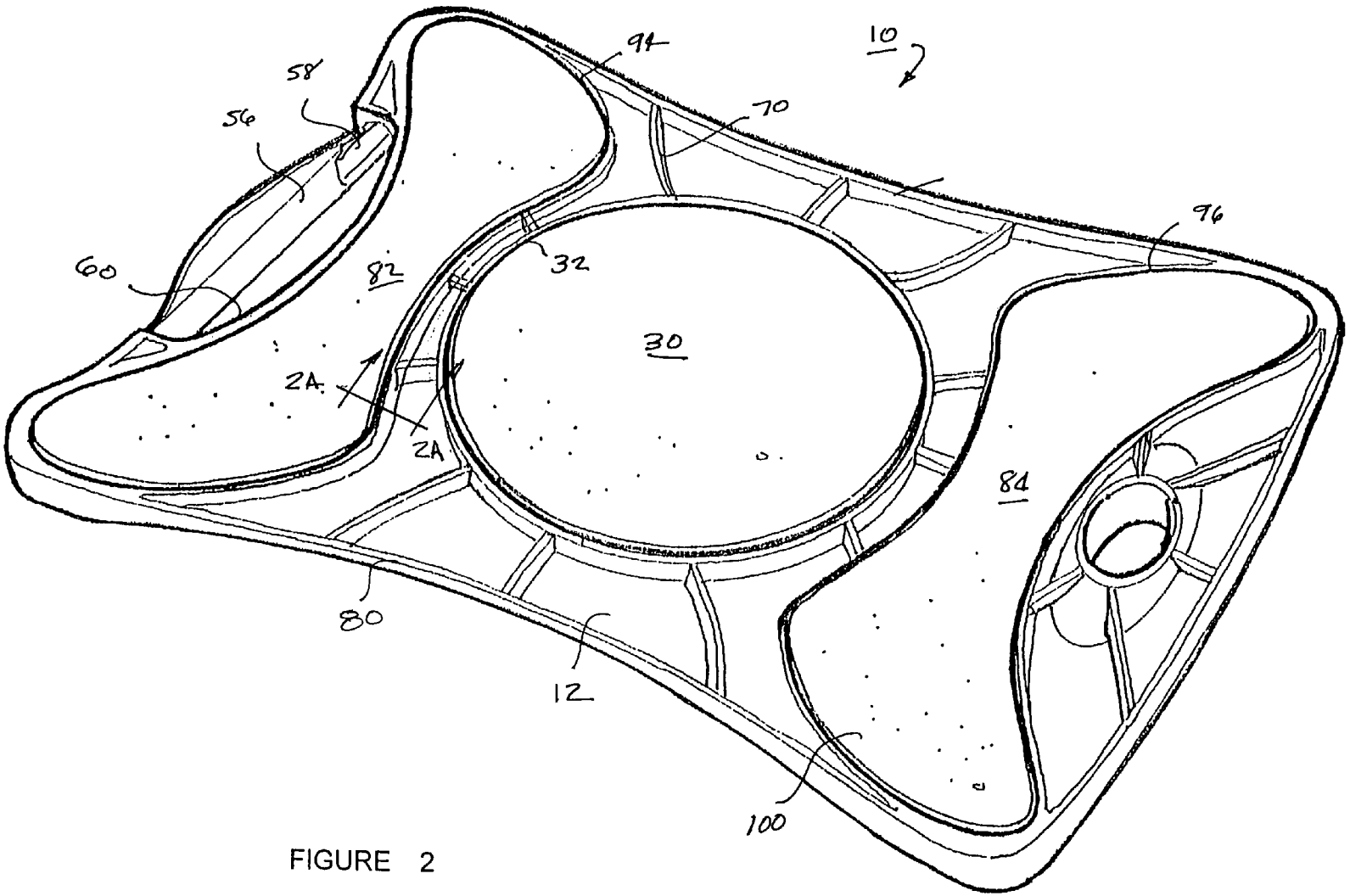
FIG. 2 is a bottom perspective view of the desk of the present invention shown with the mouse pad in a stored position.

Many laptop computers utilize a mouse which the user moves to navigate by rotating a ball or moving an optical mouse. Accordingly, mouse pad 40 is provided for this purpose. The mouse pad 40 is shown having a circular rim 50 which of a suitable rigid and durable plastic material such as ABS. The surface of the mouse pad is covered with a frictional material which will engage the mouse ball to allow the ball to be rotated as the user moves the mouse or a surface which will provide a good optical read. Again, a material such as neoprene is suitable for this purpose. The mouse pad 40 is secured to the desk by a flexible hinge section 54 which at one end 55 attaches to the ring 50. The opposite end of hinge 54 is secured to side 18 of the laptop desk. The hinge 54 can be a flexible, living hinge of plastic material which is welded, as by sonic welding, or secured by a suitable adhesive to the edge of the laptop desk. As shown, the flexible hinge terminates at a loop 56 which receives a metal hinge pin 58 which extends transversely along a recess 60 at the edge 18 of the desk. This is best seen in FIG. 2. The size of the ring 50 is selected so that in a stored position the ring can snugly be received in the central opening 30 so that the mouse pad is in an out-of-the-way position when stored.

FIG. 2 illustrates the bottom of the desk panel 12. The bottom side is generally planar and is provided with a number or reinforcing ribs 70 which extend generally radially from the circular rim 32 which extends around and defines the central opening 30. A peripheral rib 80 extends around the perimeter of the laptop desk and also serves to provide stability and rigidity to the structure. The radial and peripheral ribs connect and are formed as part of the molding process.

Cushions 82, 84 are provided extending generally between the front and rear edges of the desk at the opposite sides of the center opening on the underside of the desk. The cushions 82, 84 are each defined by a pair of peripherally extending ribs 94 and 96. The shape defined by the ribs may vary but are generally elongate extending across the width of the panel 12 and are spaced-apart so that they will normally align and rest on the upper leg or thigh area of the user when the user is seated.

Figure 2A:
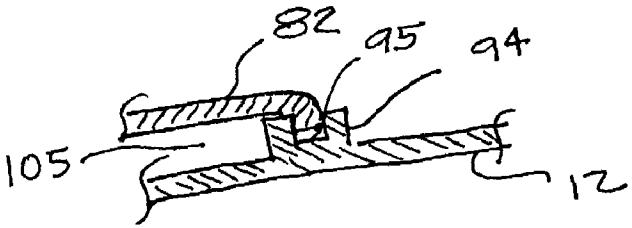
FIG. 2A is a sectional view taken along line 2A—2A of FIG. 2.
Figure 4:
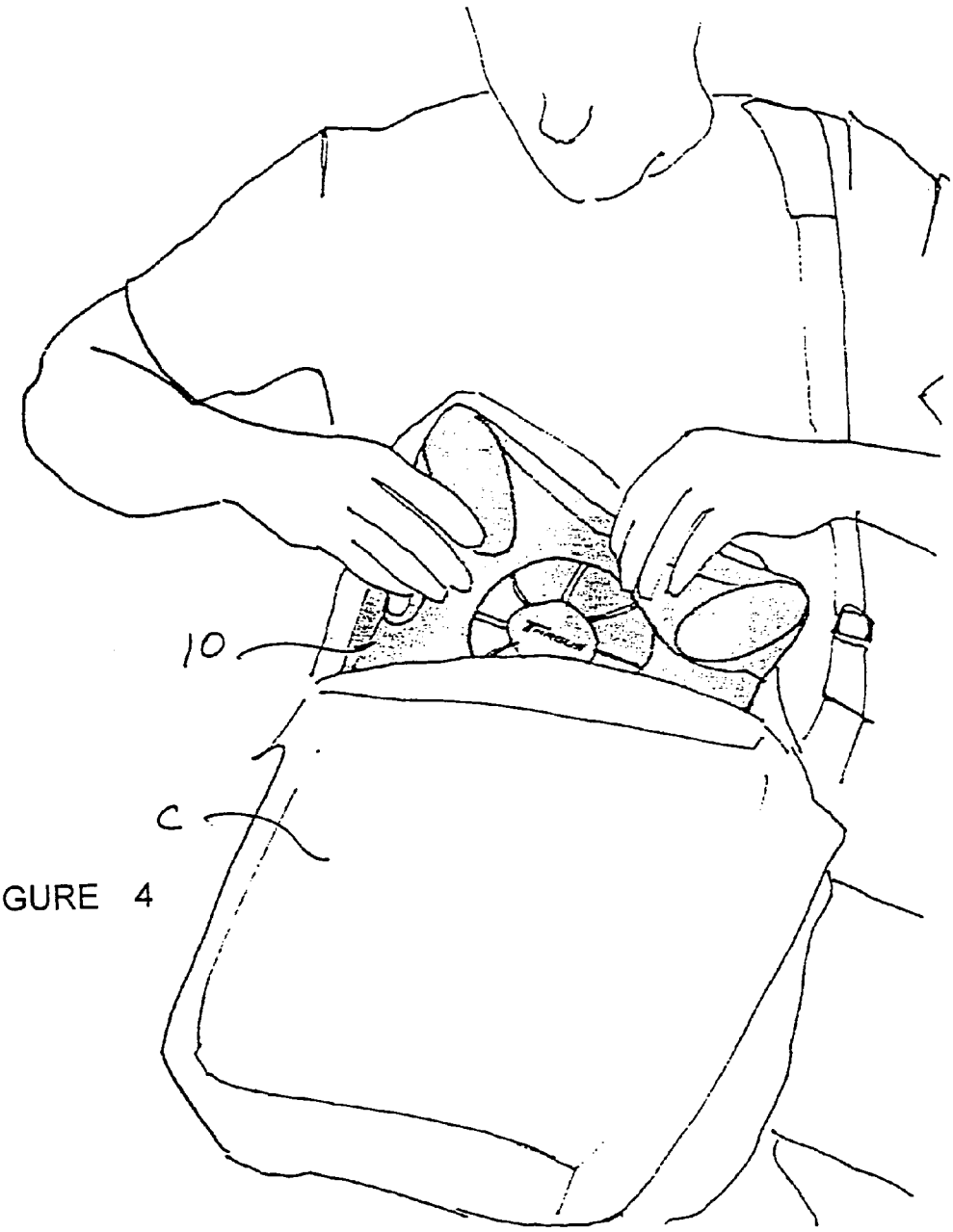
FIGS. 4 to 8 illustrate the sequence of operations when placing the portable desk of the present invention in a position of use on the user's lap with a computer in position using mouse.
Figure 5:
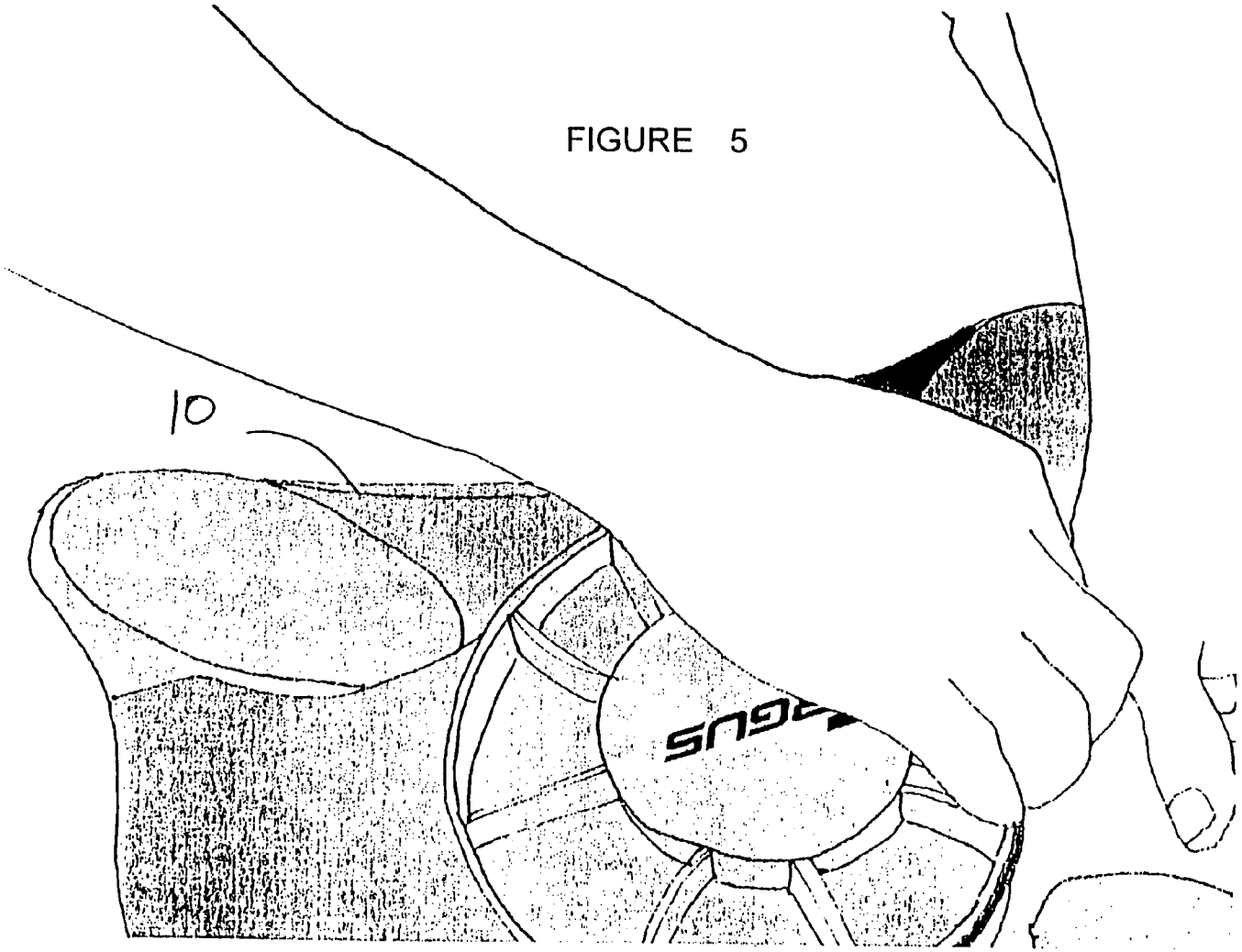
Figure 6:
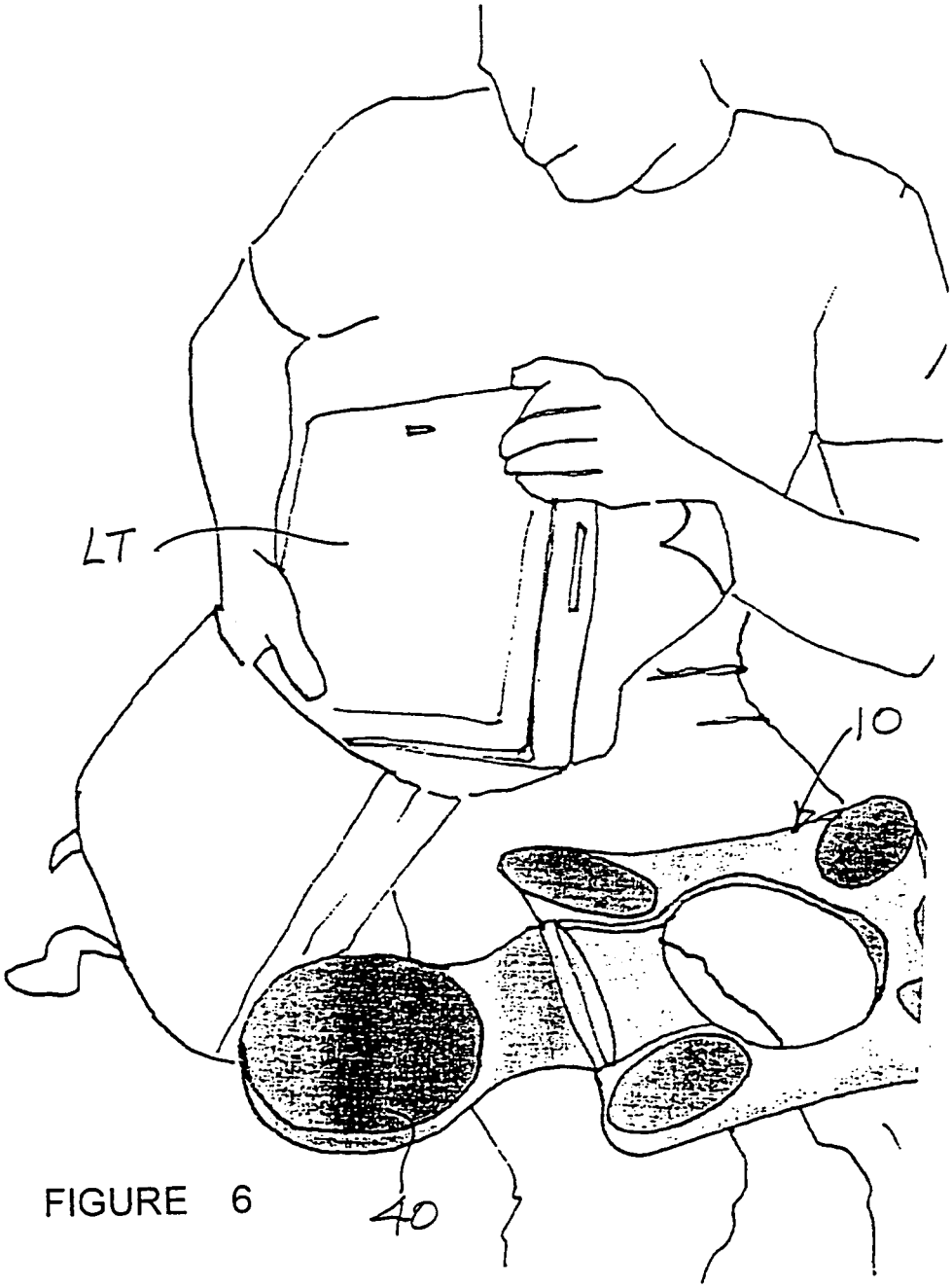
Figure 7:
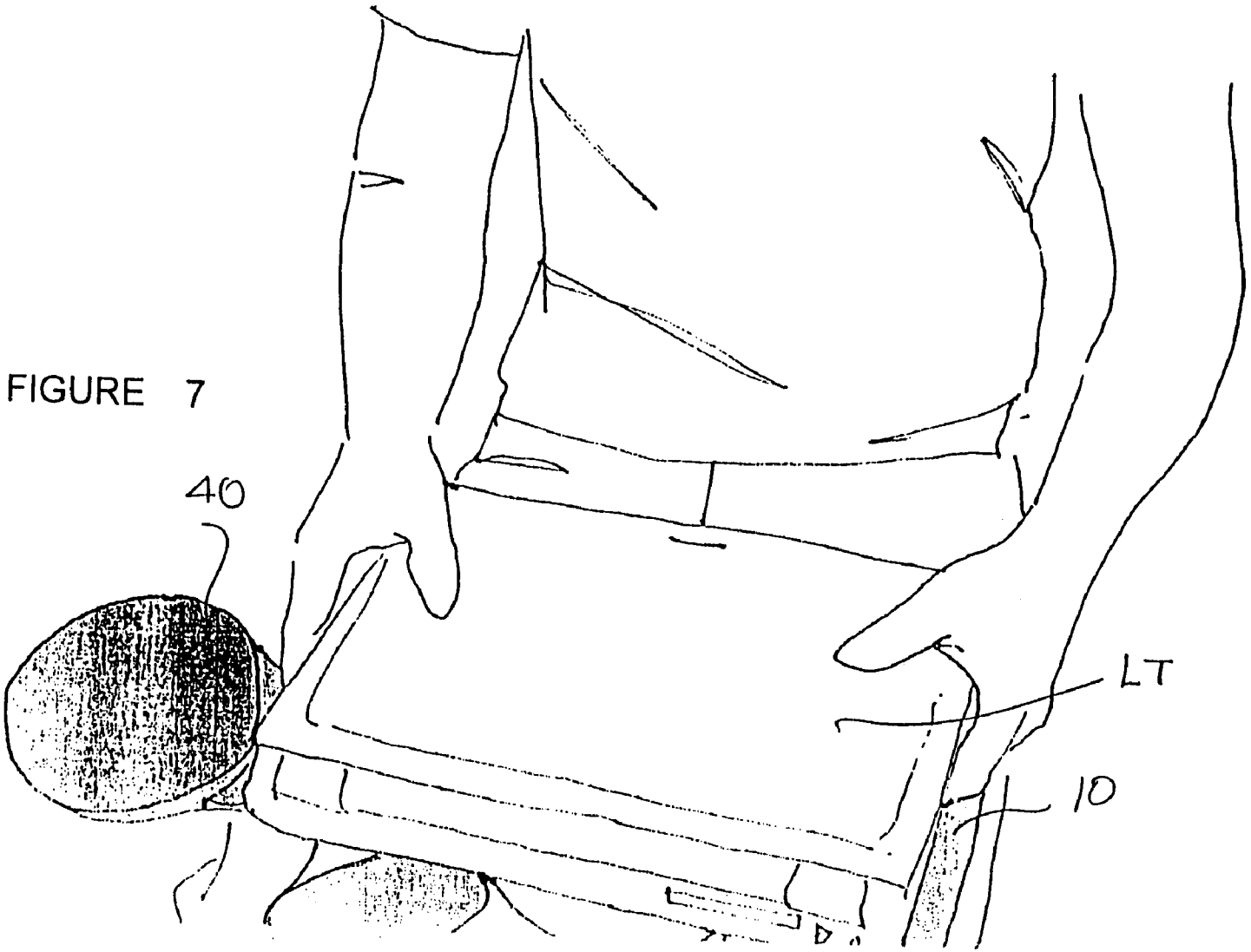
Figure 8:
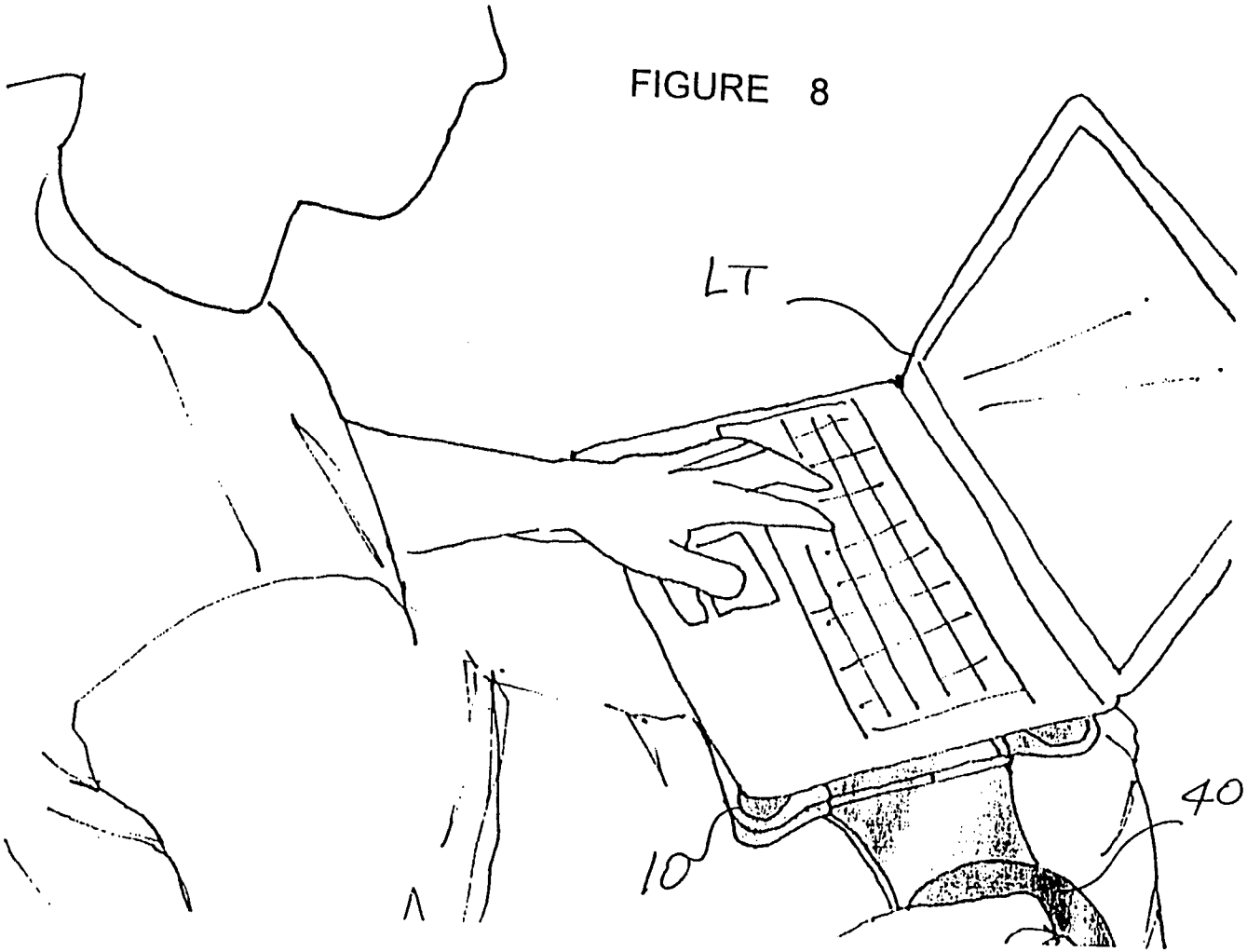

As seen in FIG. 2A, the cushions 82, 84 have a covering 100 which extends over the surface of the cushion area. The edge of the cushion material may be placed in retaining engagement with the ribs either by use of an adhesive or by engagement in a groove 95 in the ribs 94, 96. The material of the cushions may be a suitable neoprene or a material such as TPE. An air and cushioning space 105 is defined between the covering material and the under surface of the laptop desk 12. This space will also help to prevent heat from transferring to the legs of the user.

Referring now to FIGS. 4 to 8, the user will normally carry the portable laptop desk 10 in a carrying case "C" adjacent the computer. When the user wishes to use the computer at a location such as a seminar, airport waiting area or other location where a table surface is not available, the user will remove the laptop computer from the carrying case and at the same time remove the desk 10 of the present invention. Removal from the carrying case is facilitated by the thumb-finger grip 34 in the panel. The user will then place the desk on the user's lap with the cushion surfaces 82 and 84 positioned on the upper surface of the user's thighs when the user is in a sitting position. The cushioning will provide frictional engagement with the user's clothing to retain and stabilize the desk panel in the proper position and also facilitates heat transfer. The mouse pad 40 can then be unfolded or extended to a use position at the side of the laptop desk by pivoting from the stored position in which the mouse pad is received within the center opening 30. The laptop computer LT can then be placed on the upper surface of the laptop desk. The surface area of the cushioning pads 42, 44, 46 and 48 are generous in size and will accommodate computer cases of varying dimensions. Further, the pads will also serve to frictionally engage the underside of the computer case to keep it from slipping.

The user can then proceed with use of the computer entering commands using a mouse. The heat generated by the computer will be allowed to dissipate along the top surface of the laptop desk in the shallow troughs 26, 28 at the front and rear edges of the computer and in the air space below the computer as the case is slightly elevated. Heat will also dissipate by flowing upwardly through the center hole 30 and around the computer away from the user. The pads 42, 44, 46 and 48, as well as the cushions 90, 92 on the underside of the desk, will serve to insulate the user from heat generated by the computer.

Figure 9:
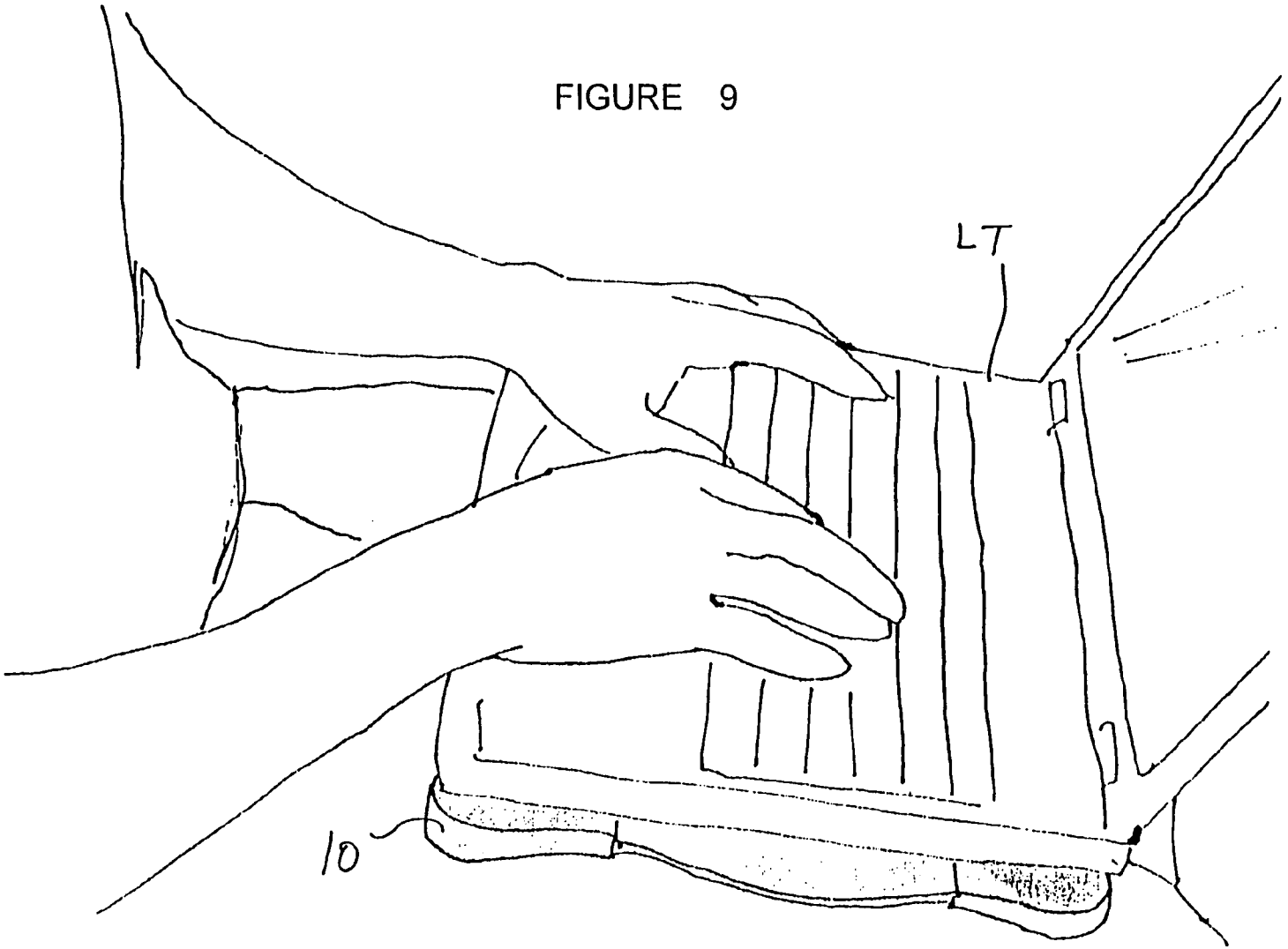
FIG. 9 shows a computer in a use position with the user entering commands via a keyboard.
Figure 10:
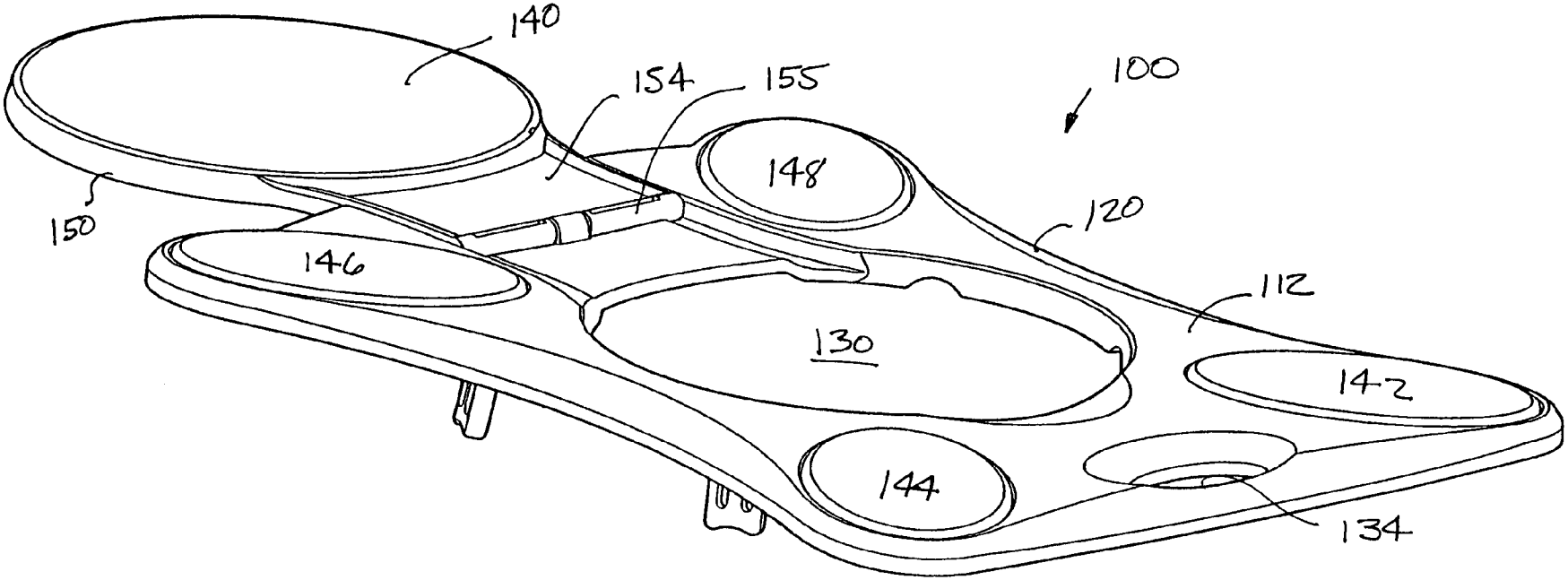
FIG. 10 is a top perspective view of another embodiment of the laptop desk of the present invention which is provided with folding legs.

In FIG. 9, the user is shown entering commands to the laptop LT via a keyboard. In this mode, the mouse pad 40 may be left in a stored position in the center aperture or cutout 30 or may be deployed for better heat dissipation.

Turning now to FIGS. 10 to 13, an alternate embodiment of the desk is shown which is designated by the numeral 100. The desk has a panel 112, as described previously, with a central cutout 130 and apertures 182, 184, 186 and 188 which receive pads 142, 144, 146 and 148 to provide cushioning and increase the frictional engagement with the supported laptop. A mouse pad 140 is hinged to the panel 112 by a hinge 154 which is located at 155 extending to the mouse pad ring 150.

Figure 11:
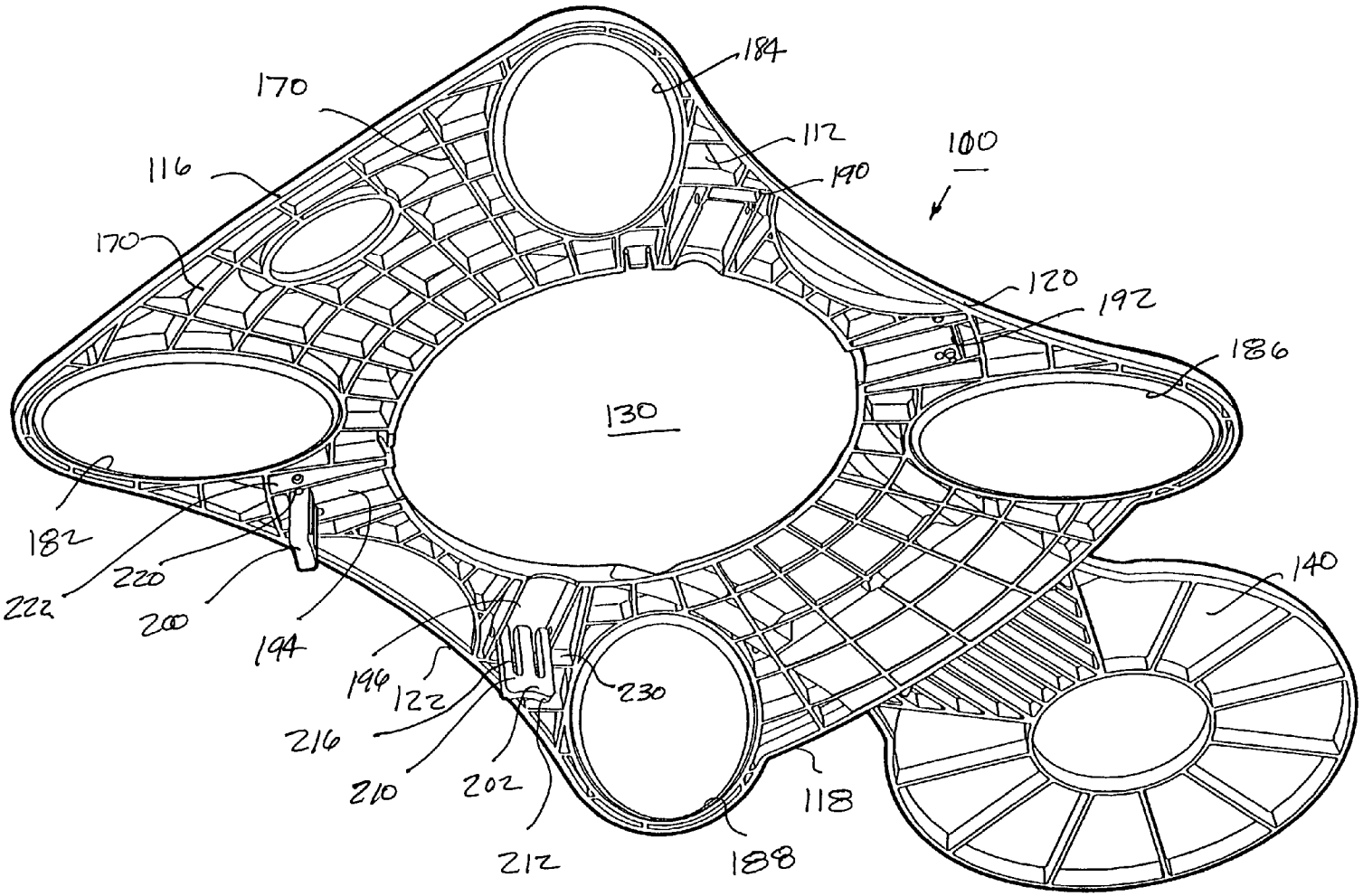
FIG. 11 is a bottom perspective view of the desk shown in FIG. 10.

As seen in FIG. 11, the underside of the panel 112 has a plurality of ribs 170 extending radially from the center and also as a plurality of concentric arcs. The panel, as has been described in preferably injection molded plastic and the ribs 170 add strength and rigidity allowing the panel to remain relatively light weight. The particular pattern of the ribs is a matter of design.

The apertures 182, 184, 186 and 188 which extend through the panel and are at spaced-apart locations around the cutout 130. The apertures receive cushioning and frictional pads as described.

Recesses 190, 192, 194 and 196 are located at spaced-apart locations. Recesses 194, 196 are located adjacent rear edge 122 at the panel 112.

One or both pairs of recesses are provided with folding legs. Legs 200, 202 are shown in recesses 194, 196 which, when extended, will provide the proper inclination of the work surface for a right-handed user. If the panel is rotated so the mouse pad is on the left side of the user, the legs in recesses 190, 192 would be extended.

Figure 13:
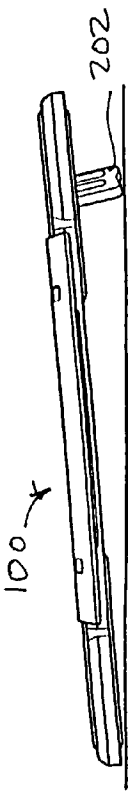
FIG. 13 is a side view showing legs deployed and the desk positioned on a planar surface to provide an inclined working surface on which a portable computer may be placed.
Figure 12:
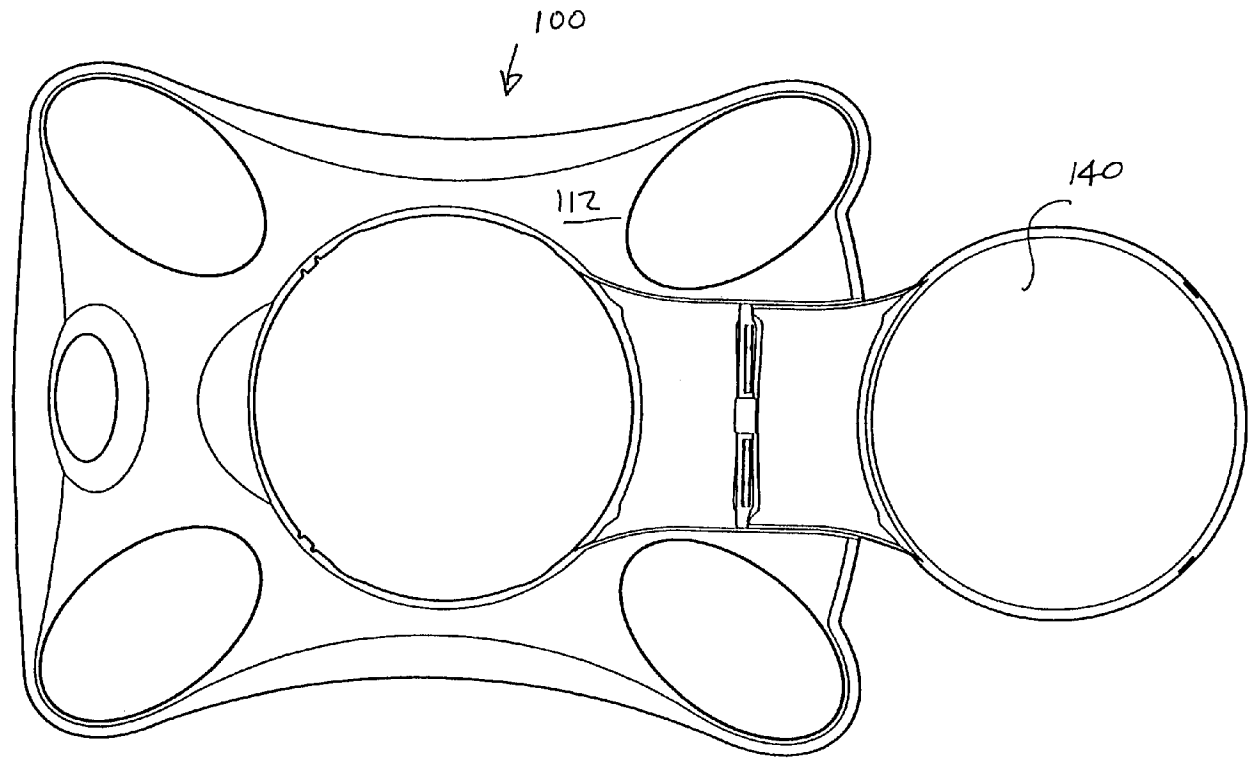
FIG. 12 is an edge view showing the pair of legs deployed.
Figure 12:
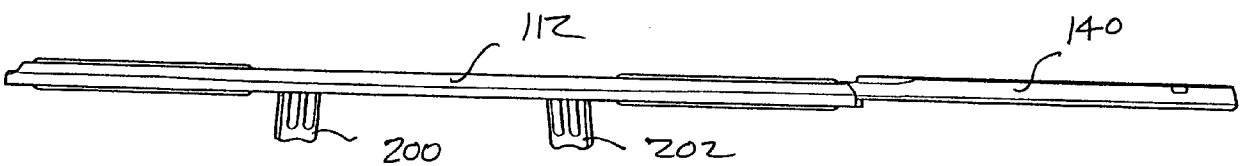

The legs each have a generally rectangular body 210 having an arcuate bottom edge 212. The body is slotted at 216 and a pivot pin 220 extends through the upper end of the bottom and is received in the opposite walls 222 of the recess. The legs are stored or housed in an out-of-the-way position in the recesses when not in use or not required. When the user wishes to elevate one side of the panel to impart an inclination of the panel 112, the user will manually pivot selected legs downwardly, as seen in FIGS. 12 and 13. The rear wall 230 of each recess abuts the legs and serves as a stop. It is noted the legs pivot past a perpendicular position with respect to the panel so when weight is placed on the desk, the legs are biased to remain in the deployed position.

From the foregoing, it will be apparent that the present invention provides a portable computer desk and is compact and is conveniently storable in a carrying case with the computer. The desk provides pathways for heat dissipation and padding to insulate the user from heat. The surface of the desk is provided with pads which will prevent the desk and computer from slipping during use. The design is ergonomic and will position the computer in a proper use position and further provide a convenient location for positioning a computer mouse.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. A desk for portable computers comprising:

(a) a substantially rigid panel having a top and bottom surface and defining a cutout;

(b) at least one resilient pad on said top surface positioned to support and retain a computer placed thereon;

(c) cushion means on said bottom surface to engage the legs of a user when the user is in a seated position; and (d) a mouse pad having a rim dimensioned to be received in said cutout, said pad having a hinge section extending from said rim, said hinge section being pivotally coupled to said panel, said pad having a stored position in which the pad is folded inwardly and is positioned in said cutout and a deployed use position in which the pad is folded outwardly to a position adjacent said panel.

2. The desk of claim 1 including air passageways extending along said top surface for heat dissipation.

3. The desk of claim 1 further including an aperture in said panel providing a finger grip location.

4. The desk of claim 1 wherein said pad is TPE.

5. The desk of claim 1 wherein said cushion means defines an air space with the bottom surface of said panel.

6. The desk of claim 1 wherein said panel is fabricated from the group of materials selected from the group consisting of ABS, TPE, Lexan and polycarbonate.

7. The desk of claim 1 wherein said panel is provided with ribs on the bottom surface for increased rigidity and strength.

8. The desk of claim 1 wherein said panel is generally rectangular having opposite sides and front and rear sides.

9. The desk of claim 8 wherein said sides are slightly curved.

10. The desk of claim 1 further including at least one pair of legs hinged to the panel and having an extended position to impart an inclination to the top surface when the desk is placed on a planar surface.

11. The desk of claim 10 wherein said pair of legs are housed in recesses in the bottom of said panel.

12. The desk of claim 10 including two pairs of legs.

* * * * *